United States Patent [19]

Tuchiya et al.

[11] 4,085,929

[45] Apr. 25, 1978

[54] PAPER FEEDER INCLUDING AUXILIARY BELTS FOR IMPROVING PAPER FEEDING

[75] Inventors: Keiji Tuchiya; Junjiro Kubota; Katuo Takahashi; Etsuo Suzuki, all of Tokyo, Japan

[73] Assignee: Nippon Electric Co., Ltd., Tokyo, Japan

[21] Appl. No.: 756,652

[22] Filed: Jan. 4, 1977

[51] Int. Cl.[2] ..... B65H 3/52

[52] U.S. Cl. ..... 271/122; 271/272

[58] Field of Search ..... 271/122, 124, 125, 34, 271/35, 10, 137, 167, 272

[56] References Cited

U.S. PATENT DOCUMENTS 3,635,465 1/1972 Beery ..... 271/122

FOREIGN PATENT DOCUMENTS 1,186,083 1/1965 Germany ..... 271/122

OTHER PUBLICATIONS

Falcone, V. J., "Document Separator," *IBM Technical Disclosure Bulletin,* vol. 4, No. 4, Sept. 1961, p. 1.

*Primary Examiner*—Bruce H. Stoner, Jr.
*Attorney, Agent, or Firm*—Sughrue, Rothwell, Mion, Zinn and Macpeak

[57] ABSTRACT

A paper feeder comprising a roller-belt feeder unit for feeding sheets of paper or the like one by one from a stack thereof to a utilization device and further comprising an auxiliary belt in contact with the feed roller of the feeder unit on its upper half circumferential surface for pressing the leading edge of the lowermost sheet of paper down to the feed roller. The auxiliary belt is substantially parallel at the area of contact to the main belt comprised by the feeder unit to feed the superposed sheet back to the stack and forms at the area of contact with the lowermost sheet an acute angle smaller than another angle similarly formed by the main belt with the lowermost sheet. The coefficient of friction is the greatest for the roller and smallest for the auxiliary belt. The auxiliary belt may be kept still, passively driven by the roller, or positively driven either in the same or in the reversed sense as the main belt.

12 Claims, 5 Drawing Figures

PAPER FEEDER INCLUDING AUXILIARY BELTS FOR IMPROVING PAPER FEEDING

BACKGROUND OF THE INVENTION

This invention relates to a paper feeder, as called herein, for automatically successively feeding sheets of paper or of equivalents one by one. A paper feeder according to this invention is specifically suitable in supplying originals to a facsimile transmitter, a copying machine, or a like utilization device.

A conventional paper feeder for feeding sheet of paper to a utilization device successively one by one comprises a table on which sheets of paper are to be stacked, a feed roller between the table and the utilization device, first means for driving the roller in a first sense of rotation of feeding the paper from the table to the utilization device, a backwardly feeding belt movable generally above the roller along a circumferential area of the roller in contact with the area, second means for driving the belt in that second sense of drive at the area which is opposite to the first sense, and third means for supplying the stacked sheets to the area. The belt has a smaller coefficient of friction with respect to the paper than the roller. When the third means supplies the lowermost sheet to the area with one or more sheets superposed thereon, the belt feeds the superposed sheet or sheets back towards the table so as to insure only one sheet to be fed at a time by the feed roller. It is, however, not seldom that the superposed sheet or sheets are not reliably subsequently fed by the conventional paper feeder because the belt is liable either to turn over the leading edges of the superposed sheets or to partially raise the superposed sheets upwards from the underlying lowermost sheet.

SUMMARY OF THE INVENTION

It is therefore a general object of the present invention to provide a reliably automatically operable paper feeder.

It is a specific object of this invention to provide a paper feeder, wherein a feed roller reliably successively feeds only one lowermost sheet of stacked sheets of paper to a utilization device.

As described hereinabove, a conventional paper feeder for successively feeding sheets of paper one by one from a stack thereof to a utilization device through an output point comprises a feed roller rotatable around a substantially horizontal fixed axis, a first belt movable in contact with a first area of an upper half circumferential surface of the roller, supply means for supplying at least one sheet from the stack to the first area through a planar area approximately tangential to the roller along a line parallel on the first area to the fixed axis, first means for rotating the roller so as to drive the first area in a first sense of drive away from the planar area towards the output point, and second means for driving the first belt in a second sense of drive which is opposite at the first area to the first sense. The roller is placed between the planar area and the output point. Insofar as that part of the first belt which is adjacent to the first area is concerned, the first belt is extended along a first straight line that forms a first acute angle with the planar area. In accordance with this invention, the conventional paper feeder is made to further comprise a second belt in contact with a second area of the upper half circumferential surface. So far as that part of the second belt which is adjacent to the second area is concerned, the second belt is extended substantially parallel to the first belt and along a second straight line that forms a second acute angle with the planar area. The second acute angle has to be smaller than the first acute angle.

DESCRIPTION OF THE PREFERRED EMBODIMENTS

Figure 1:
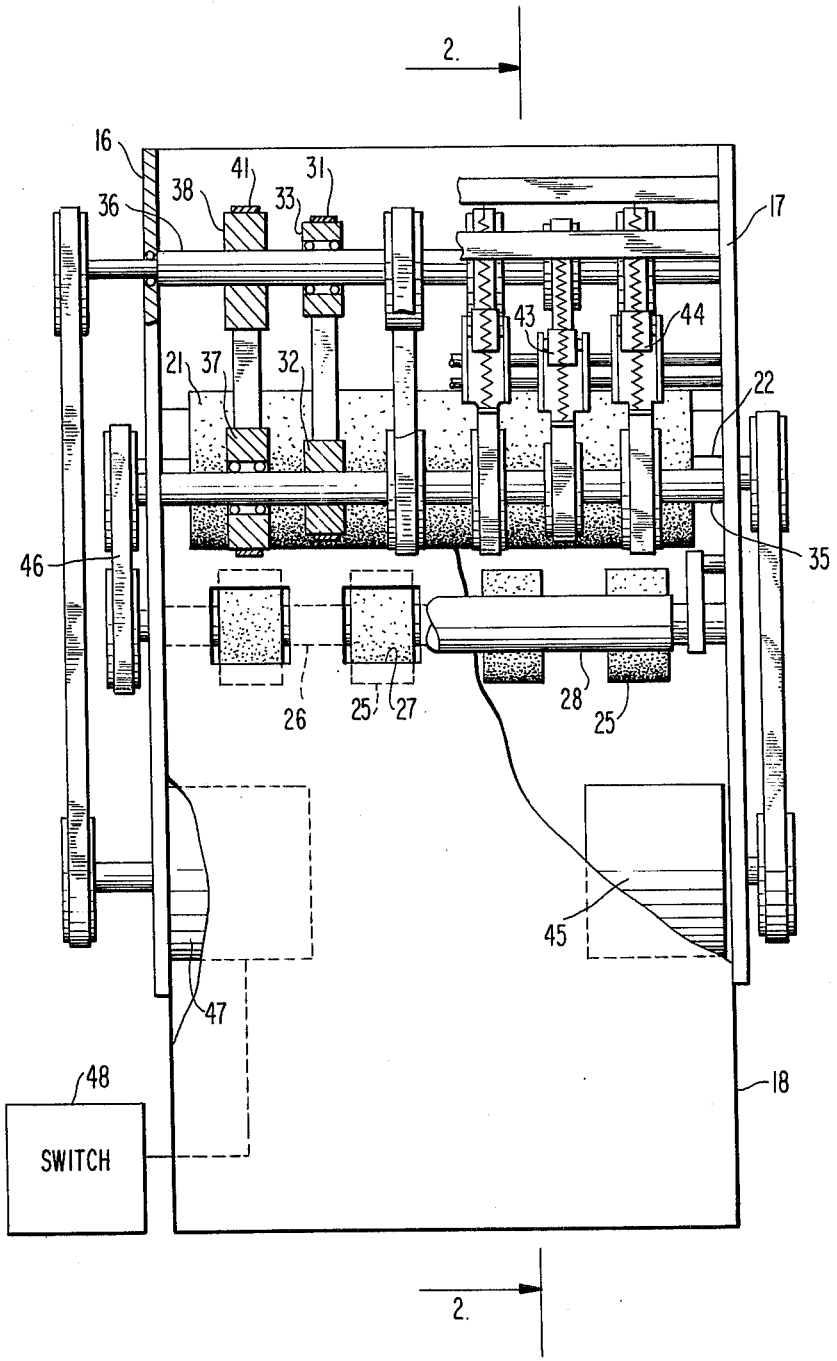
FIG. 1 is a schematic plan, partially cut away, of a paper feeder according to a first embodiment of the present invention.
Figure 2:
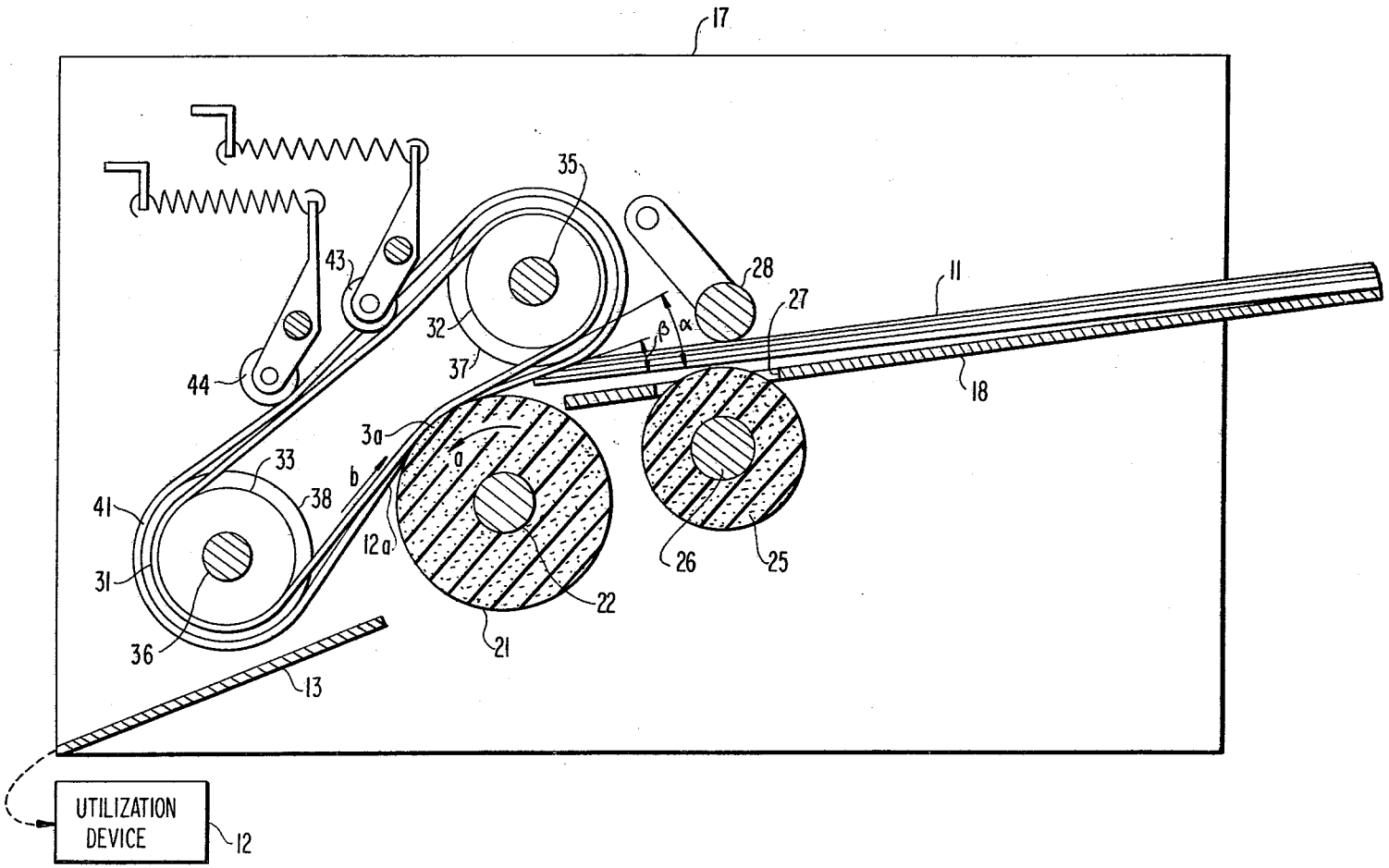
FIG. 2 is an enlarged schematic vertical sectional view, taken on a line 2—2 in FIG. 1, of the paper feeder according to the first embodiment of this invention.

Referring to FIGS. 1 and 2, a paper feeder according to a first embodiment of the present invention is for successively feeding sheets of paper or the like from a stack 11 thereof to a utilization device 12 through an output point 13 and comprises a pair of side walls 16 and 17 and a table 18 between the side walls 16–17. As best shown in FIG. 2, the table 18 is for putting the stack 11 thereon and preferably slightly inclined so that its leading or front edge, nearer to the output point 13 along a path of paper feed, is lower than its rear edge. A main feed roller 21 having a circumferential surface made of rubber or a material having a large coefficient of friction with respect to the paper is axled between the table 18 and the output point 13 on a main shaft 22 extended substantially horizontally between the side walls 16–17. A plurality of auxiliary feed rollers 25 axled on an auxiliary shaft 26 disposed below the table 18 are in contact with the lowermost sheet of the stack 11 through holes 27 formed through the table 18. A pinch roller 28 is spring urged to the uppermost sheet of the stack 11. A plurality of first endless belts 31 having a smaller coefficient of friction with respect to the paper than the main feed roller surface are movable in contact with first areas on an upper half circumferential surface of the main feed roller 21. In cooperation with the pinch roller 28, the auxiliary feed rollers 25 supply at least the lowermost sheet to the first areas along a planar area which is approximately tangential to the main feed roller 21 at a line parallel on the first areas to the main shaft 22. Each belt 31 is carried by a first small pulley 32 and a second small pulley 33. The first pulleys 32 are fixed to a first axle 35 while the second pulleys 33 are rotatable around a second axle 36, while axles 35–36 are extended substantially horizontally between the side walls 16–17. First and second large pulleys 37 and 38 are rotatable around and fixed to the first and second axles 35–36 between first and second small pulleys 32–33, respectively.

Further referring to FIGS. 1 and 2, each pair of the first and second large pulleys 37–38 carries a second or auxiliary endless belt 41. The second endless belts 41 have a still smaller coefficient of friction with respect to the paper than the first endless belts 31 and are movable in contact with second areas of the upper half circumferential surface of the main feed roller 21. Tension rollers 43 and 44 are spring urged to the first and second endless belts 31 and 41, respectively. Due to the difference in diameter of the small and large pulleys 32–33 and 37–38, a first acute angle $\alpha$ formed with the planar area by a first straight line parallel to which the first endless belts 31 are extended at their parts adjacent to the first areas is greater than a second acute angle $\beta$ formed with the planar area by a second straight line parallel to which the second endless belts 41 are extended at their portions adjacent to the second areas. A first electric motor 45 drives the main shaft 22 which, in turn, rotates the main feed roller 21 so as to drive the first areas in a first sense of drive *a* away from the planar area towards the output point 13.

Figure 3:
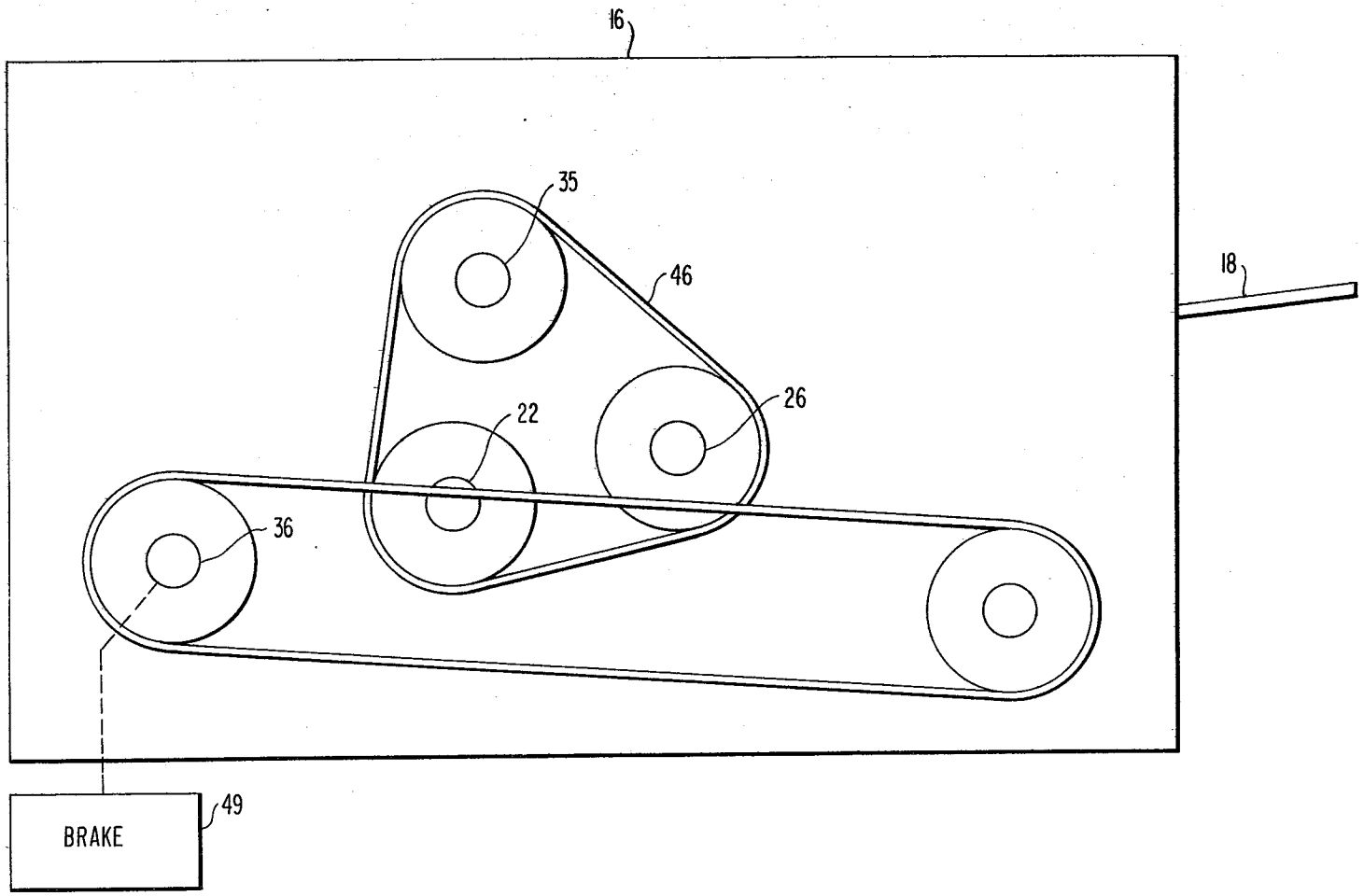
FIG. 3 is an enlarged left side view of the paper feeder illustrated in FIG. 1.

Referring to FIGS. 1 and 2 again and to FIG. 3 afresh, the main shaft 22 drives also the auxiliary shaft 26 and the first axle 35 through a power transmission belt 46 so as to drive the auxiliary feed rollers 25 with a common linear speed equal to that of the main feed roller 21 and drive the first endless belts 31 preferably with a smaller common linear speed than the main feed roller 21. As best seen from FIG. 2, the first axle 35 drives the first endless belts 31 in a second sense of drive *b* which is opposite at the first areas to the first sense *a*. A second and reversible electric motor 47 controllably drives the second axle 36. The second endless belts 41 may be thus positively driven in whichever of the first and second senses *a* and *b* by reversing the sense of rotation of the second electric motor shaft by a manually operable switch 48. Alternatively, the second endless belts 41 may either be passively driven by the main feed roller 21 with the second electric motor 47 deenergized or may be kept still by putting a brake 49 into operation so as to prevent the second axle 36 from rotating. It is preferred to avoid slip in the power transmission between the first electric motor 45 and the main shaft 22, between the main shaft 22 and the auxiliary shaft 26 and the first axle 35, and between the second electric motor 47 and the second axle 36 as by resorting to chain drives rather than to mere pulley and belt drives. It is also preferred to drive the second endless belts 41 with a smaller common linear speed than the first endless belts 31.

Figure 4:
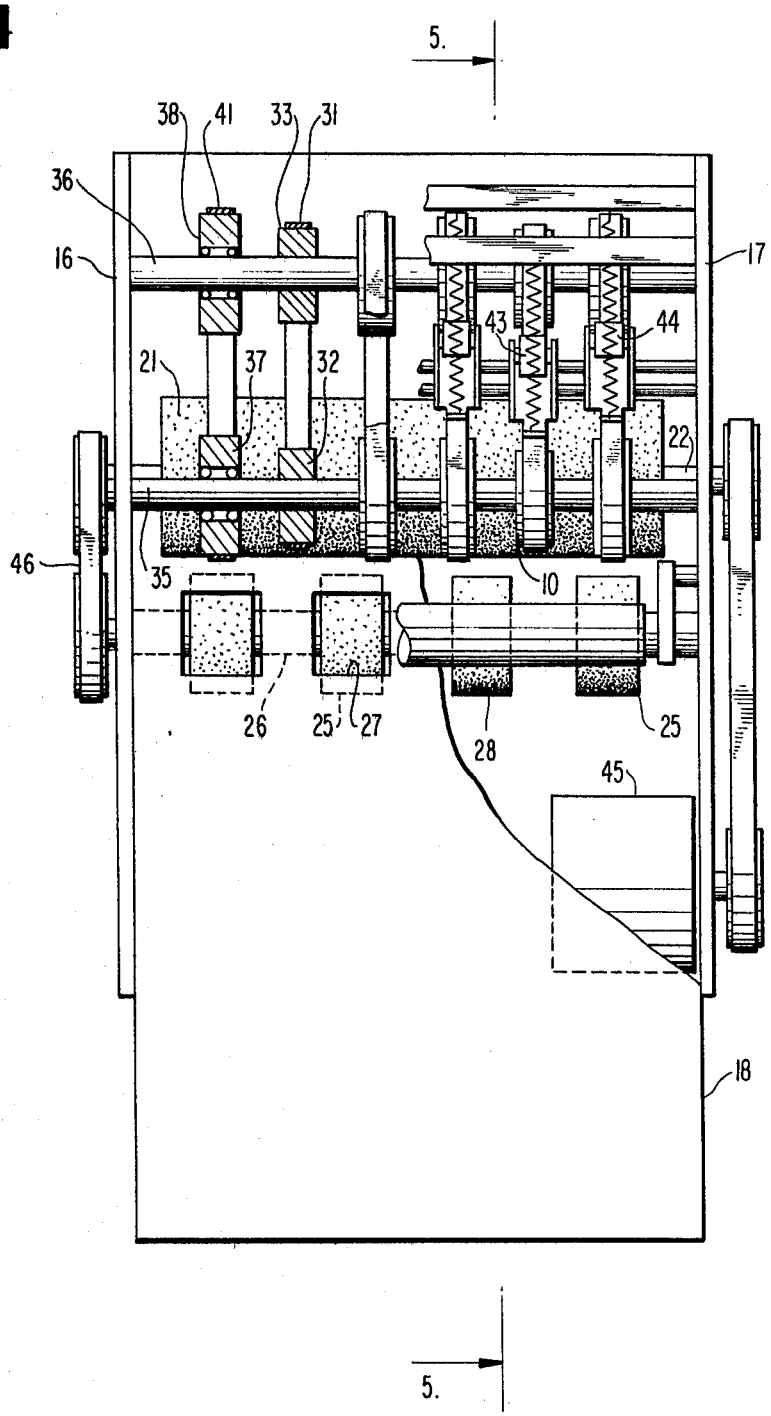
FIG. 4 is a schematic plan, partly cut away, of a paper feeder according to a second embodiment of this invention.

Referring to FIG. 4 and again to FIG. 2, a paper feeder according to a second embodiment of this invention comprises similar parts designated by like reference numerals as in FIGS. 1–3 and is specifically designed so that the second endless belts 41 may be passively driven by the main feed roller 21. The first and second small pulleys 32–33 are therefore rotatable together with the first and second axles 35–36, respectively. On the other hand, the first and second large pulleys 37–38 are rotatable around the respective axles 35–36. Use is not made of the second electric motor 47. The brake 49 is optional.

Figure 5:
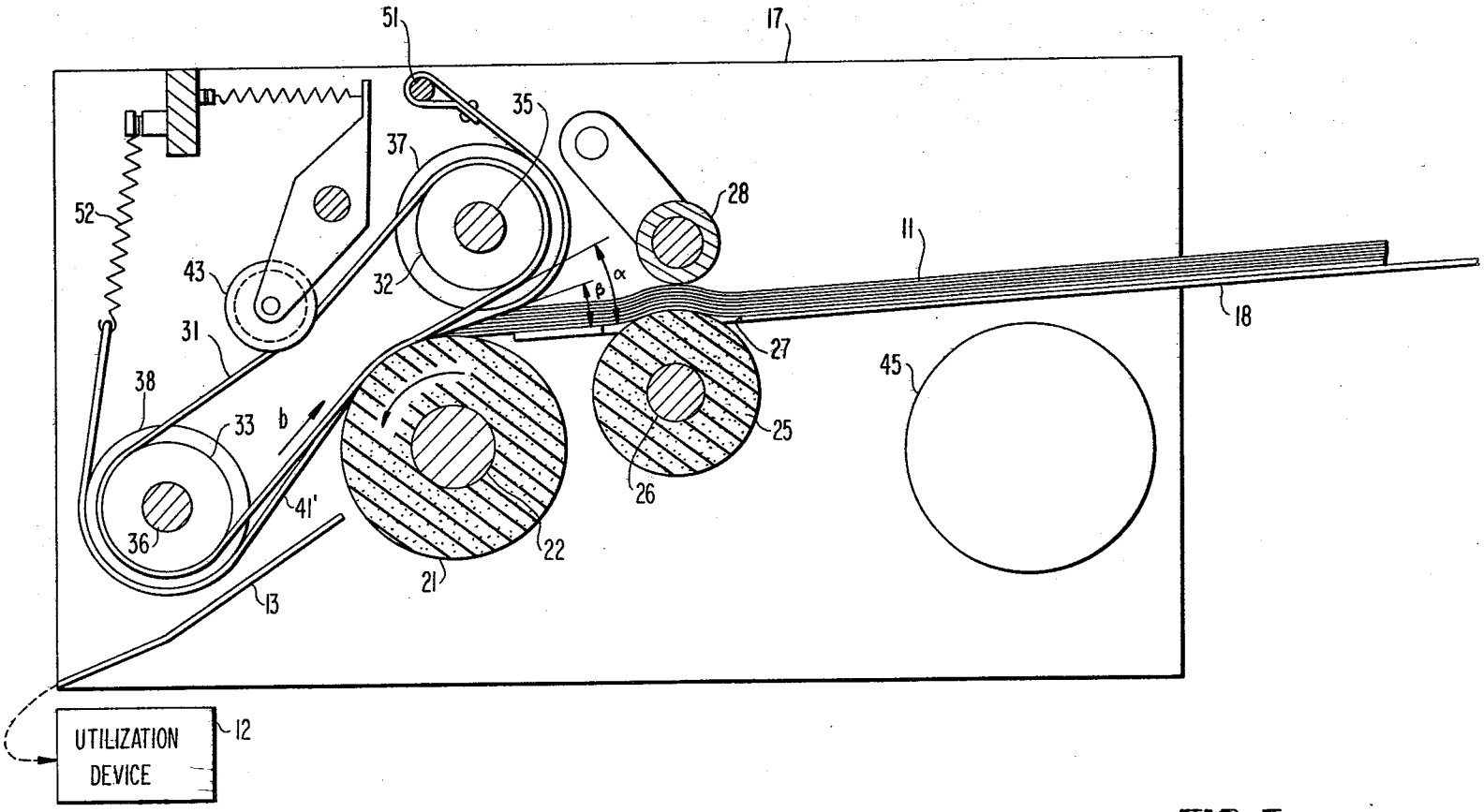
FIG. 5 is an enlarged schematic vertical sectional view, taken along a line corresponding to line 5—5 in FIG. 4, of the modified paper feeder according to a third embodiment of this invention.

Referring to FIG. 4 once again and to FIG. 5 afresh, a paper feeder according to a third embodiment of this invention again comprises similar parts designated by like reference numerals as in FIGS. 2 and 4 and is specifically designed so that second belts 41' kept still are substituted for the second belts shown in FIG. 4. The second belts 41' therefore need not be endless belts but have first ends fixed to studs 51 and second ends pulled by tension springs 52. Use is unnecessary of the tension rollers 44 for the respective second belts 41'. The first and second large pulleys 37–38 may be rotatable together with the first and second axles 35–36 or fixed relative to the axes of axles, 35–36 in sliding contact with the second belts 41'.

In operation, the first endless belts 31 feed, as described in the preamble of the instant specification, the sheet or sheets superposed on the lowermost sheet and supplied to the first areas back toward the stack 11 so as to insure only one sheet to be fed at a time by the main feed roller 21. It is to be reminded here that the first acute angle $\alpha$ of the first endless belts 31 is greater than the second acute angle $\beta$ for the second belts 41 or 41'. Each of the second belts 41 or 41', when driven in the first sense *a*, cooperates with the auxiliary feed rollers 25 to supply at least the lowermost sheet to the first areas while pressing the superposed sheet or sheets down to the lowermost sheet to prevent the first endless belts 31 from adversely acting on the superposed sheet as turning over its leading edge or as partially lifting the superposed sheet upwards from the lowermost sheet. The differences in the coefficients of friction and in the linear speeds between the first and second belts 31 and 41 or 41' insure not to feed the superposed sheet to the first areas but to reliably feed the superposed sheet or sheets subsequently one by one by the main feed roller 21 as the successive lowermost sheet. This mode of operation is specifically suitable to those sheets of paper between which friction is small so that it is readily possible to separate one sheet from another. Each of the second belts 41 or 41', when driven in the second sense *b*, assists the backward feed by the first endless belts 31 of the superposed sheet or sheets and presses the superposed sheet down to the lowermost sheet as soon as the backwardly fed sheet or sheets leave the first areas to again prevent the first endless belts 31 from adversely affecting the superposed sheet. The differences in the friction coefficients and the linear speeds insure the lowermost sheet not to be fed backwards and the superposed sheet or sheets to be subsequently fed as the successive lowermost sheet by the main feed roller 21 reliably one by one. This mode of operation is specifically suitable to those sheets of paper between which friction is appreciable. A paper feeder according to the second embodiment of this invention is preferable because of its simple structure for those sheets of paper between which the friction is relatively small. A paper feeder according to the third embodiment of this invention is featured by its still simpler construction and suited to those sheets of paper between which the friction is relatively large.

While a few preferred embodiments of this invention have so far been described, it will readily be understood that various modifications of the embodiments are possible within the scope of this invention. For example, the output point 13 may be disposed relative to the main feed roller 21 on the same side as the planar area or the table 18. The first and second belts 31 and 41 or 41' may be one each in number. The small and large pulleys 32–33 and 37–38 may be positioned on separate axles or axes. In a paper feeder according to the first embodiment, means for transmitting power from the first electric motor 45 to the second axle 36 may be substituted for the second electric motor 47.

What is claimed is:

1. A paper feeder for successively feeding sheets of paper one by one from a stack thereof to a utilization device through an output point, comprising a feed roller rotatable around a substantially horizontal fixed axis, a first belt movable in contact with a first area of an upper half circumferential surface of said roller, supply means for supplying at least one sheet from said stack to said first area through a planar area approximately tangential to said roller along a line parallel on said first area to said fixed axis, first means for rotating said roller so as to drive said first area in a first sense of drive away from said planar surface towards said output point, and second means for driving said first belt in a second sense of drive opposite at said first area to said first sense, said roller being placed between said planar area and said output point, said first belt being extended partially adjacently of said first area along a first straight line forming a first acute angle with said planar surface, wherein the improvement comprises a second belt in contact with a second area of said upper half circumferential surface, said second belt being extended partially adjacently of said second area substantially parallel to said first belt and along a second straight line forming a second acute angle with said planar area, said second acute angle being smaller than said first acute angle.

2. A paper feeder as claimed in claim 1, wherein said second belt has a smaller coefficient of friction with respect to the paper than said first belt which, in turn, has a smaller coefficient of friction than said roller.

3. A paper feeder as claimed in claim 2, further comprising third means for keeping said second belt substantially still.

4. A paper feeder as claimed in claim 3, said first belt being an endless belt, said second means comprising a first pair of pulleys rotatable around a first and a second axis extended parallel to said fixed axis, respectively, and means for driving one of said pulleys, said pulleys carrying said endless belt, wherein said third means comprises a second pair of pulleys on said first and second axes, respectively, said second belt being extended around said second pair of pulleys, said second pair of pulleys being greater in diameter than said first pair of pulleys.

5. A paper feeder as claimed in claim 4, wherein said second pair of pulleys are fixed to said first and second axes.

6. A paper feeder as claimed in claim 4, wherein said second pair of pulleys are rotatable around said first and second axes in sliding contact with said second belt.

7. A paper feeder as claimed in claim 2, further comprising third means for holding said second belt so as to be passively driven by said feed roller.

8. A paper feeder as claimed in claim 7, said first belt being a first endless belt, said second means comprising a first pair of pulleys rotatable around a first and a second axis extended parallel to said fixed axis, respectively, and means for driving one of said pulleys, said pulleys carrying said first endless belt, wherein said third means comprises a second pair of pulleys freely rotatable around said first and second axes, respectively, said second belt being a second endless belt and carried by said second pair of pulleys, said second pair of pulleys being greater in diameter than said first pair of pulleys.

9. A paper feeder as claimed in claim 2, further comprising third means for controllably positively driving said second belt.

10. A paper feeder as claimed in claim 9, said first belt being a first endless belt, said second means comprising a pair of first pulleys rotatable around a first and a second axis extended parallel to said fixed axis, respectively, and fourth means for driving that one of said first pulleys which is rotatable around said first axis, said pulleys carrying said first endless belt, wherein said third means comprises a pair of second pulleys rotatable around said first and second axes, respectively, and fifth means for controllably positively driving that one of said second pulleys which is rotatable around said second axis, said second belt being a second endless belt and carried by said second pulleys, said second pulleys being greater in diameter than said first pulleys.

11. A paper feeder as claimed in claim 10, said fourth means being capable of driving said one of said first pulleys so as to drive said first endless belt with a first linear speed, wherein said fifth means is capable of driving said one of said second pulleys controllably positively with a second linear speed that is smaller than said first linear speed.

12. A paper feeder as claimed in claim 11, wherein said third means further comprises a manually operable switch for controlling said fifth means so as to make said fifth means drive said one of said second pulleys in a selected sense of rotation, whereby said second endless belt is driven at said second area in a selected one of said first and second senses.

* * * * *